US007881628B2

(12) United States Patent
Itagaki

(10) Patent No.: US 7,881,628 B2
(45) **Date of Patent: *Feb. 1, 2011**

(54) IMAGE FORMING APPARATUS THAT IDENTIFIES HALFTONE PROCESS PARAMETER

(75) Inventor: Tomohisa Itagaki, Abiko (JP)

(73) Assignee: Canon Kabushiki Kaisha (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/399,531

(22) Filed: Mar. 6, 2009

(65) Prior Publication Data

US 2009/0180789 A1 Jul. 16, 2009

Related U.S. Application Data

(63) Continuation of application No. 11/468,560, filed on Aug. 30, 2006, now Pat. No. 7,512,350.

(30) Foreign Application Priority Data

Sep. 1, 2005 (JP) ..... 2005-254006

(51) Int. Cl.
*G03G 15/00* (2006.01)

(52) U.S. Cl. ..... 399/49; 399/72

(58) Field of Classification Search ..... 399/49, 399/51, 60, 72

See application file for complete search history.

(56) References Cited

U.S. PATENT DOCUMENTS

| | | | | |
|---|---|---|---|---|
| 5,450,165 | A | 9/1995 | Henderson | |
| 6,014,499 | A | 1/2000 | Sasaki | |
| 6,188,418 | B1 | 2/2001 | Hata | |
| 7,512,350 | B2 * | 3/2009 | Itagaki | 399/49 |
| 7,539,428 | B2 | 5/2009 | Yamada | |
| 2005/0007609 | A1 | 1/2005 | Itagaki et al. | |

FOREIGN PATENT DOCUMENTS

| | | | |
|---|---|---|---|
| JP | 7-92385 | A | 4/1995 |
| JP | 9-319270 | A | 12/1997 |
| JP | 10-075368 | A | 3/1998 |
| JP | 10-304201 | A | 11/1998 |
| JP | 11-305515 | A | 11/1999 |
| JP | 2000-131890 | A | 5/2000 |
| JP | 2003-228201 | A | 8/2003 |
| JP | 2004-191501 | A | 7/2004 |
| JP | 2005-003906 | A | 1/2005 |
| JP | 2005-215561 | A | 8/2005 |

OTHER PUBLICATIONS

Office Action issued in corresponding Japanese Patent Application No. 2005-254006 dated Dec. 4, 2009.
Office Action issued in corresponding Japanese Patent Application No. 2005-254006 dated Mar. 26, 2010.

* cited by examiner

*Primary Examiner*—Hoang Ngo
(74) *Attorney, Agent, or Firm*—Rossi, Kimms & McDowell LLP

(57) ABSTRACT

An image forming apparatus appropriately adjusts an image forming conditions even if a halftone-processed image data is inputted. The image forming apparatus forms a patch image by applying a halftone process which is substantially equivalent to the halftone process which has been previously performed for the inputted image data. The image forming apparatus detects the density of the formed patch image and adjusts the image forming conditions according to the detected density.

6 Claims, 18 Drawing Sheets

FIG. 8

SCANNING PIXEL PERIOD

| SCANNING PIXEL PERIOD | 0 | 8 | 9 | 10 | 11 | 12 | 13 | 14 | 15 | 16 | 17 | 18 | 19 | 20 |
|---|---|---|---|---|---|---|---|---|---|---|---|---|---|---|
| 0 | | 0.0° | 0.0° | 0.0° | 0.0° | 0.0° | 0.0° | 0.0° | 0.0° | 0.0° | 0.0° | 0.0° | 0.0° | 0.0° |
| | | 300LINES | 267LINES | 240LINES | 218LINES | 200LINES | 185LINES | 171LINES | 160LINES | 150LINES | 141LINES | 133LINES | 126LINES | 120LINES |
| 8 | 90.0° | 45.0° | 41.6° | 38.7° | 36.0° | 33.7° | 31.6° | 29.7° | 28.1° | 26.6° | 25.2° | 24.0° | 22.8° | 21.8° |
| | 300LINES | 212LINES | 199LINES | 187LINES | 176LINES | 166LINES | 157LINES | 149LINES | 141LINES | 134LINES | 128LINES | 122LINES | 116LINES | 111LINES |
| 9 | 90.0° | 48.4° | 45.0° | 42.0° | 39.3° | 36.9° | 34.7° | 32.7° | 31.0° | 29.4° | 27.9° | 26.6° | 25.3° | 24.2° |
| | 267LINES | 199LINES | 189LINES | 178LINES | 169LINES | 160LINES | 152LINES | 144LINES | 137LINES | 131LINES | 125LINES | 119LINES | 114LINES | 109LINES |
| 10 | 90.0° | 51.3° | 48.0° | 45.0° | 42.3° | 39.8° | 37.6° | 35.5° | 33.7° | 32.0° | 30.5° | 29.1° | 27.8° | 26.6° |
| | 240LINES | 187LINES | 178LINES | 170LINES | 161LINES | 154LINES | 146LINES | 139LINES | 133LINES | 127LINES | 122LINES | 117LINES | 112LINES | 107LINES |
| 11 | 90.0° | 50.4° | 50.7° | 47.7° | 45.0° | 42.5° | 40.2° | 38.2° | 36.3° | 34.5° | 32.9° | 31.4° | 30.1° | 28.8° |
| | 218LINES | 176LINES | 169LINES | 161LINES | 154LINES | 147LINES | 141LINES | 135LINES | 129LINES | 124LINES | 119LINES | 114LINES | 109LINES | 105LINES |
| 12 | 90.0° | 56.3° | 53.1° | 50.2° | 47.5° | 45.0° | 42.7° | 40.6° | 38.7° | 36.9° | 35.2° | 33.7° | 32.3° | 31.0° |
| | 200LINES | 166LINES | 160LINES | 154LINES | 147LINES | 141LINES | 136LINES | 130LINES | 125LINES | 120LINES | 115LINES | 111LINES | 107LINES | 103LINES |
| 13 | 90.0° | 58.4° | 55.3° | 52.4° | 49.8° | 47.3° | 45.0° | 42.9° | 40.9° | 39.1° | 37.4° | 35.8° | 34.4° | 33.0° |
| | 185LINES | 157LINES | 152LINES | 146LINES | 141LINES | 136LINES | 131LINES | 126LINES | 121LINES | 116LINES | 112LINES | 108LINES | 104LINES | 101LINES |
| 14 | 90.0° | 60.3° | 57.3° | 54.5° | 51.8° | 49.4° | 47.1° | 45.0° | 43.0° | 41.2° | 39.5° | 37.9° | 36.4° | 35.0° |
| | 171LINES | 149LINES | 144LINES | 139LINES | 135LINES | 130LINES | 126LINES | 121LINES | 117LINES | 113LINES | 109LINES | 105LINES | 102LINES | 98LINES |
| 15 | 90.0° | 61.9° | 59.0° | 56.3° | 53.7° | 51.3° | 49.1° | 47.0° | 45.0° | 43.2° | 41.4° | 39.8° | 38.3° | 36.9° |
| | 160LINES | 141LINES | 137LINES | 133LINES | 129LINES | 125LINES | 121LINES | 117LINES | 113LINES | 109LINES | 106LINES | 102LINES | 99LINES | 96LINES |
| 16 | 90.0° | 63.4° | 60.6° | 58.0° | 55.5° | 53.1° | 50.9° | 48.8° | 46.8° | 45.0° | 43.3° | 41.6° | 40.1° | 38.7° |
| | 150LINES | 134LINES | 131LINES | 127LINES | 124LINES | 120LINES | 116LINES | 113LINES | 109LINES | 106LINES | 103LINES | 100LINES | 97LINES | 94LINES |
| 17 | 90.0° | 64.8° | 62.1° | 59.5° | 57.1° | 54.8° | 52.6° | 50.5° | 48.6° | 46.7° | 45.0° | 43.4° | 41.8° | 40.4° |
| | 141LINES | 128LINES | 125LINES | 122LINES | 119LINES | 115LINES | 112LINES | 109LINES | 106LINES | 103LINES | 100LINES | 97LINES | 94LINES | 91LINES |
| 18 | 90.0° | 66.0° | 63.4° | 60.9° | 58.6° | 56.3° | 54.2° | 52.1° | 50.2° | 48.4° | 46.6° | 45.0° | 43.5° | 42.0° |
| | 133LINES | 122LINES | 119LINES | 117LINES | 114LINES | 111LINES | 108LINES | 105LINES | 102LINES | 100LINES | 97LINES | 94LINES | 92LINES | 89LINES |
| 19 | 90.0° | 67.2° | 64.7° | 62.2° | 59.9° | 57.7° | 55.6° | 53.6° | 51.7° | 49.9° | 48.2° | 46.5° | 45.0° | 43.5° |
| | 126LINES | 116LINES | 114LINES | 112LINES | 109LINES | 107LINES | 104LINES | 102LINES | 99LINES | 97LINES | 94LINES | 92LINES | 89LINES | 87LINES |
| 20 | 90.0° | 68.2° | 65.8° | 63.4° | 61.2° | 59.0° | 57.0° | 55.0° | 53.1° | 51.3° | 49.6° | 48.0° | 46.5° | 45.0° |
| | 120LINES | 111LINES | 109LINES | 107LINES | 105LINES | 103LINES | 101LINES | 98LINES | 96LINES | 94LINES | 91LINES | 89LINES | 87LINES | 85LINES |

IMAGE FORMING APPARATUS THAT IDENTIFIES HALFTONE PROCESS PARAMETER

CROSS REFERENCE TO RELATED APPLICATION

This is a continuation of and claims priority from U.S. patent application Ser. No. 11/468,560 filed Aug. 30, 2006 now U.S. Pat. No. 7,512,350, the content of which is incorporated herein by reference.

BACKGROUND OF THE INVENTION

1. Field of the Invention

The present invention relates to an image forming technology.

2. Description of the Related Art

It is important to stabilize the quality of an image formed in image forming devices. Generally, in electrophotographic image forming apparatus, image forming density (e.g., the amount of color material) becomes unstable due to variations in each part (e.g., amount of electric charge retained in color material) and variations in installation environment (e.g., temperature and humidity). The image forming density also becomes unstable by variations in sensitivity of photosensitive material and environmental variations in transfer member.

As an approach for stabilizing formed images, a method of controlling developing conditions (Japanese Patent Application Laid-Open No. 09-319270) or a method of modifying image data (Japanese Patent Application Laid-Open No. 2003-228201) are generally used.

In the method of controlling developing conditions, first, a patch image is formed on a photosensitive material or transfer member as an image conveyer. Next, the toner density of the formed patch image is detected. Depending on the detected toner density, the ratio of magnetic powder to toner in a developing device is controlled.

Similarly, in the method of modifying image data, the toner density of a formed patch image is detected. Depending on the detected toner density, the values of a γLUT (Gamma Look-Up Table) is modified. The γLUT is a table for performing one-dimensional transformation of image data. This γLUT can determine a value corresponding to the input data (primarily 0-255) and outputs the determined value (also 0-255).

However, the method of controlling developing conditions has a difficulty, since control response is typically low when developing conditions is changed. That is, there is a drawback in that it takes relatively longer time to settle the variation.

As compared to the method of controlling developing conditions, the method of transforming image data is advantageous with respect to the response of control, since feedback from the detection result of the patch image is applied to the γLUT. In this method, the transformation process of the image data using the γLUT is first performed, and then halftone process must be performed.

However, in recent years, it is becoming popular that halftone-processed image data is inputted to image forming apparatus. The halftone-processed image data as represented by 1 Bit Tiff has binary (i.e., 0 and 255) data only. Therefore, even if these data are processed using the γLUT, 0 and 255 are merely transformed to 0 and 255, respectively. As a result, when halftone-processed image is inputted, the method of modifying the γLUT using the patch image no longer makes sense.

SUMMARY OF THE INVENTION

An image forming apparatus according to the present invention identifies a process parameter of a halftone process which has been applied to an input image data in advance, and forms a patch image by the halftone process according to the identified process parameter. Then the density of the formed patch image is detected, and image forming conditions is adjusted according to the detected density.

According to the present invention, the patch image is formed by a halftone process which is substantially equivalent to the halftone process which has been applied to the input image data in advance. The density of the formed patch image is detected, and image forming conditions is adjusted according to the detected density. This enables the image forming conditions to be appropriately adjusted even if the halftone-processed image data is inputted.

Further features of the present invention will become apparent from the following description of exemplary embodiments (with reference to the attached drawings).

BRIEF DESCRIPTION OF THE DRAWINGS

FIG. 8 is the relation among base resolution, number of lines, and angle;

DESCRIPTION OF THE EMBODIMENTS

Some embodiments according to the present invention will be described in detail below with reference to the drawings.

First Embodiment

Figure 1:
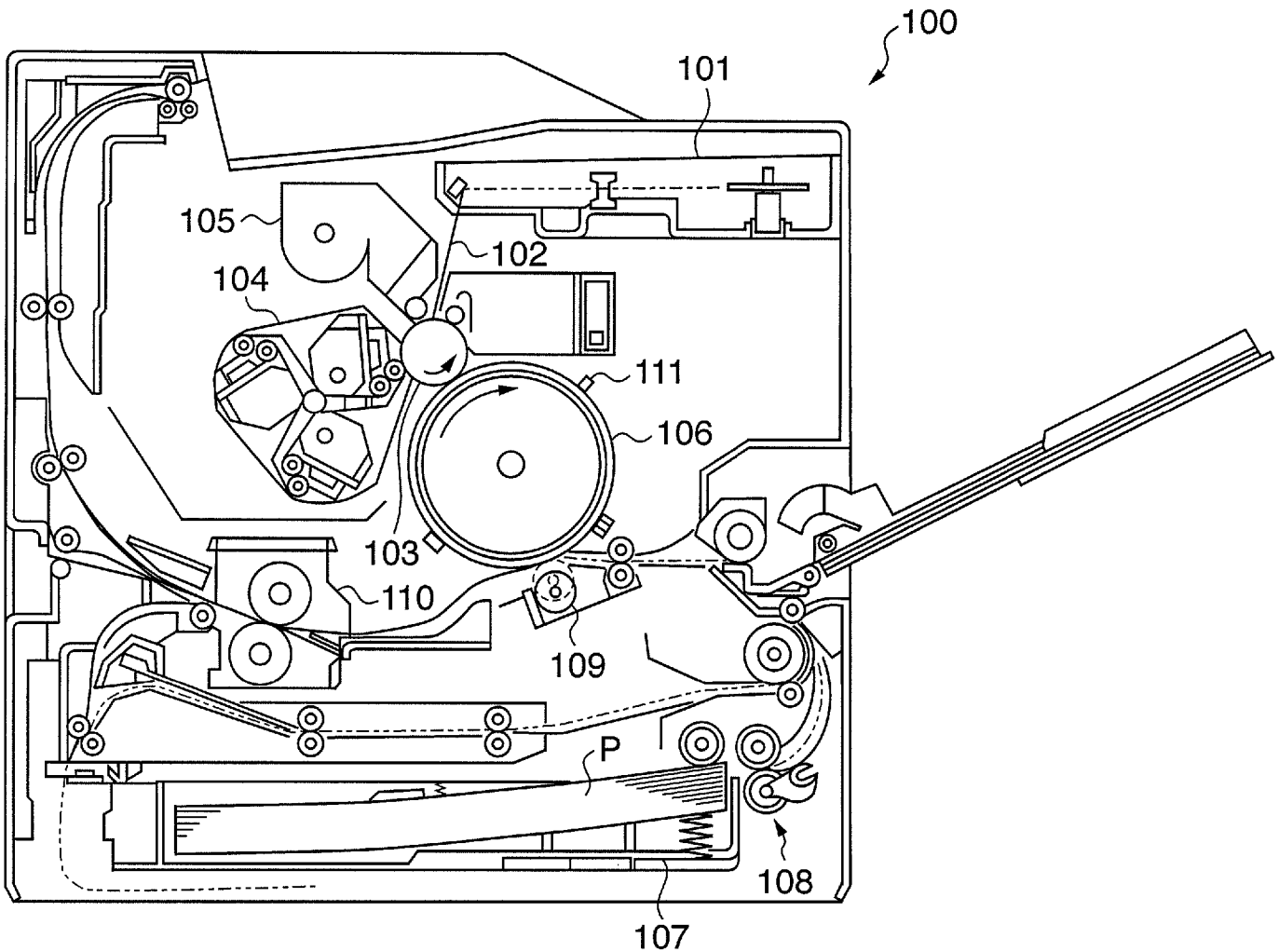
FIG. 1 is an exemplary configuration of an image forming apparatus according to an embodiment.

FIG. 1 is an exemplary configuration of an image forming apparatus according to an embodiment. Here, as an example of the image forming apparatus, an electrophotographic color laser beam printer 100 is used.

The printer 100 employs a so-called rotary-type image forming station. Of course, the present invention can also be applied to a tandem-type image forming station. The tandem-type image forming station is typically made of a plurality of image forming units arranged in parallel and an intermediate transfer belt. The configuration of the tandem-type image forming station is well-known to those skilled in the art, and therefore not described in detail.

A light emitting part (scanner part) 101 is made of an optical source, a polygon mirror, etc. Output light 102 from the optical source (e.g., laser diode or LED) is modulated by an image data for each color component obtained from a print data. An electrostatic latent image is formed by scanning a photosensitive drum 103 by the polygon mirror. Driving force by a driving motor, not shown, is transferred to the photosensitive drum 103 which rotates in a counter-clockwise direction in response to the image forming operation.

This electrostatic latent image is developed with color material (e.g., developer such as toner) to obtain a visible image (toner image). A rotary developing device 104, for example, comprises three color developing devices for developing yellow (Y), magenta (M) and cyan (C). Rotating the rotary developing device 104 enables toner transferred to the photosensitive drum 103 to be selected. In this example, a black developing device 105 is provided independently of the rotary developing device 104.

A visible image formed on the photosensitive drum 103 is sequentially multiplex transferred to an intermediate transfer member 106. In this way, a color visible image is formed.

A transfer material (such as a paper) P loaded in a paper cassette 107 is carried to a transfer part 109 by a feed part 108 including a plurality of rollers. In the transfer part 109, the color visible image is transferred to the transfer material P. Further, in a fixing part 110, the color visible image is fixed to the transfer material P.

A density sensor 111 is a sensor for detecting the density (the amount of color material) of the visible image formed on the intermediate transfer member 106. Its detailed configuration will be described below.

Figure 2:
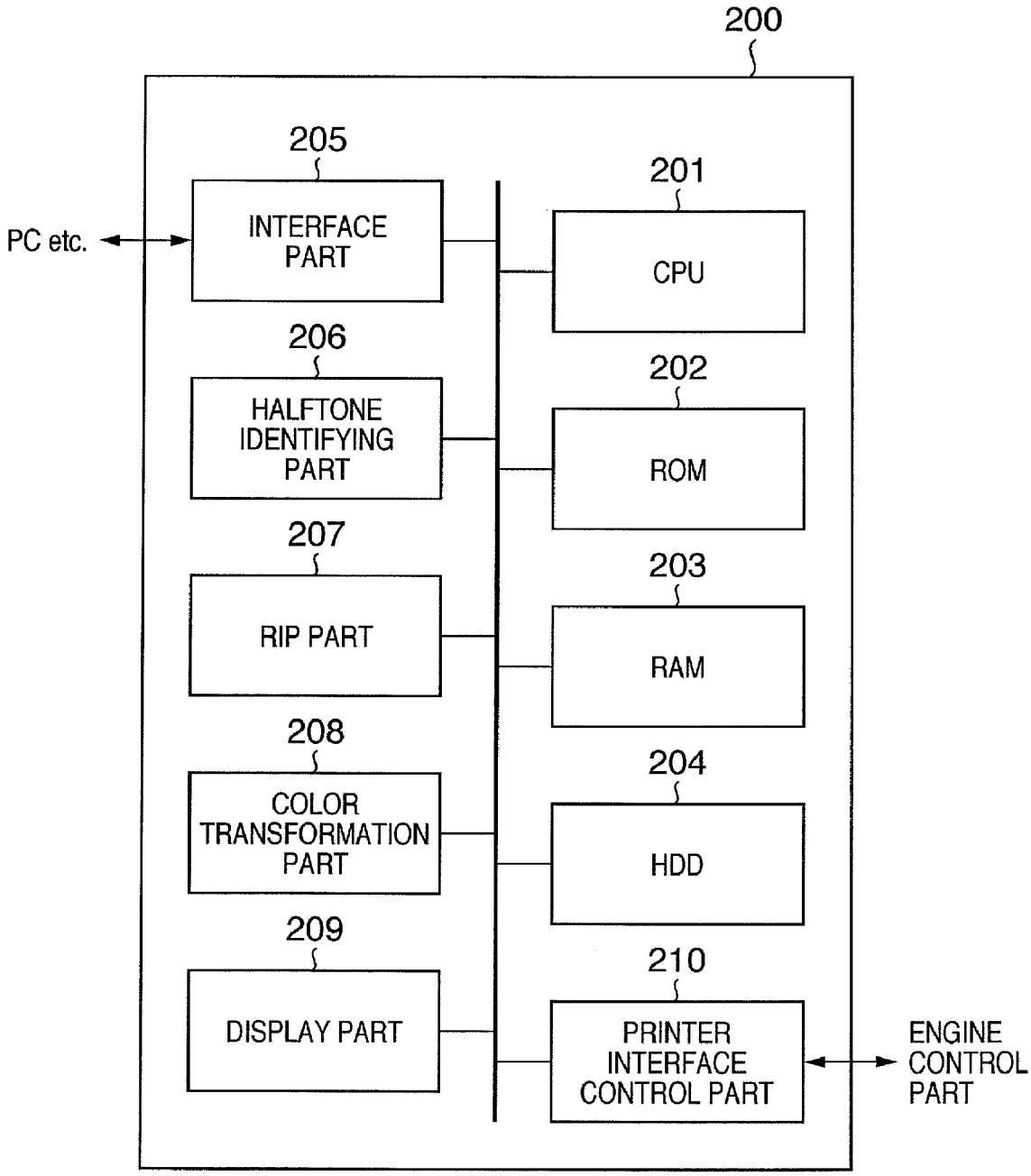
FIG. 2 is an exemplary block diagram of a controller part according to an embodiment.

FIG. 2 is an exemplary block diagram of a controller part according to an embodiment. A CPU 201 is a control circuit for controlling each part of the controller part 200 in a centralized manner. A ROM 202 is a non-volatile storage part for storing a control program and the like. A RAM 203 is a volatile storage part functioning as a work area for the CPU 201. An HDD (Hard Disk Drive device) 204 is a mass storage part for storing various data.

An interface part 205 inputs data for printing (e.g., data described in Page Description Language (PDL)) transmitted from a PC (Personal Computer), other controller or the like, or inputs an image data such as in PDF or TIFF format. A halftone identifying part 206 determines whether or not a halftone process is performed for the inputted image data in advance, or identifies the content of the halftone process.

A RIP (Raster Image Processor) part 207 transforms the inputted image data to a bitmap image or the like (raster process). A color transformation part 208 transforms a color space of the inputted image data. For example, A color space in RGB, L*a*b or the like is transformed to CMYK or the like which is a color space in a printer part.

The rasterized or color transformed image data is sent to an engine control part (FIG. 3) via a printer interface control part 210. A data of the patch image including a frequency information described below may also be transmitted in conjunction with the image data. The data of the patch image is generated, for example, if the halftone identifying part 206 determines that it is halftone-processed.

A display part 209 is a display circuit such as a liquid crystal display device. For example, the display part 209 displays the status of the printer 100, controller part 200 and the like. The display part 209 may also be touch panel operation part.

Figure 3:
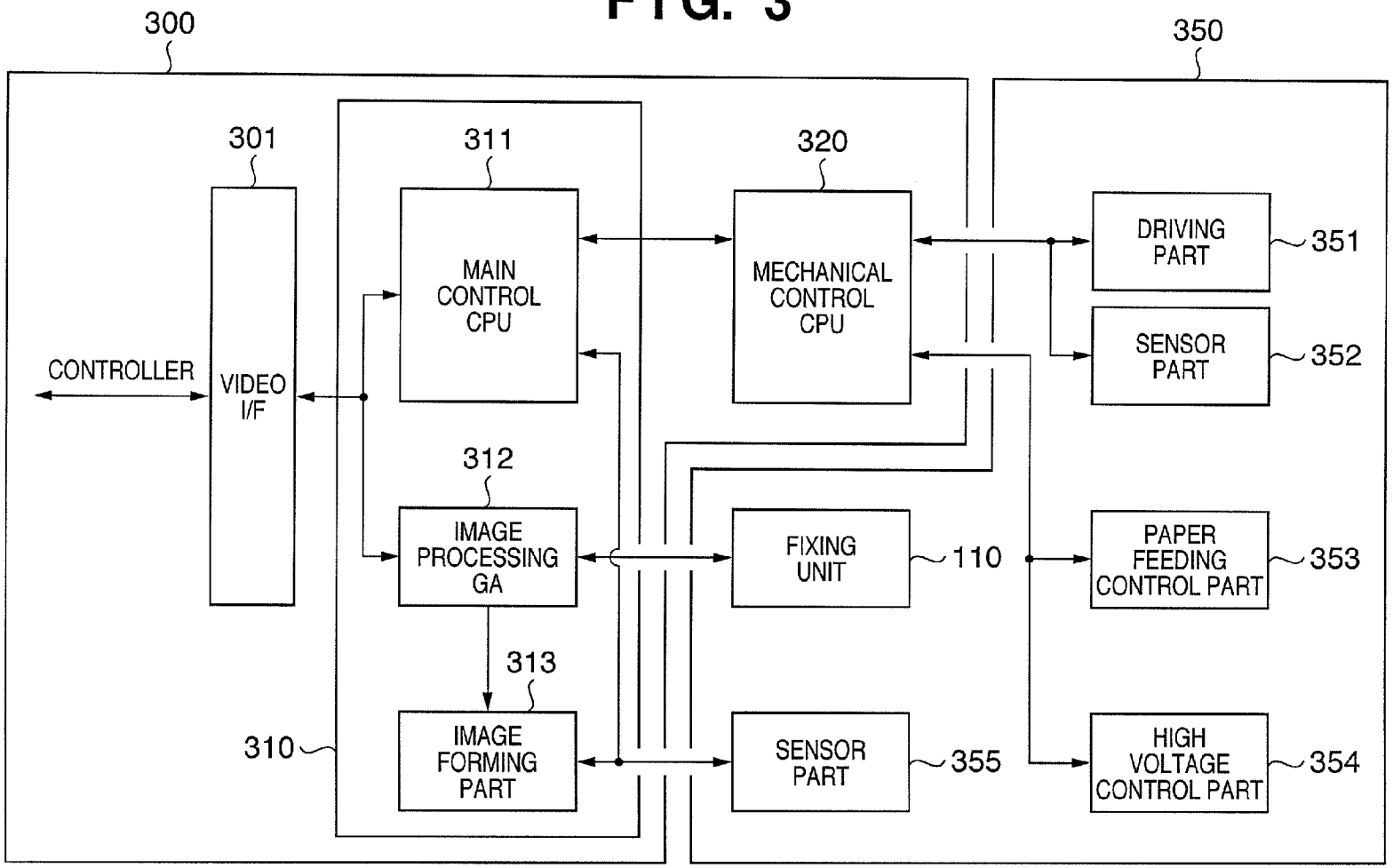
FIG. 3 is an exemplary block diagram of an engine control part according to an embodiment.

FIG. 3 is an exemplary block diagram of an engine control part and a printer engine part according to an embodiment. The printer 100 is divided into a controller part 200, an engine control part 300 and printer engine part 350. The engine control part 300 primarily comprises following parts. A video interface 301 is an interface circuit for connecting with the controller part 200. A main control part 310, for example, comprises a main control CPU 311, an image processing gate array 312 and an image forming part 313.

The main control CPU 311 is a control circuit which controls each part of the printer part in a centralized manner and controls a mechanical control CPU 320 as a sub-CPU. The image forming gate array 312 is an image processing circuit for performing γ correction for the image data received from the interface 301. The image forming part 313 controls the amount of exposure and light emission duration of laser. The mechanical control CPU 320 controls a driving part 351, sensor part 352, a paper feeding control part 353 and high voltage control part 354.

The driving part 351 is a motor, clutch, fan and the like. The sensor part 352 is a position sensor for the transfer material P and the like. The paper feeding control part 353 controls feeding of the transfer material P. The high voltage control part 354 controls the amount of electrostatic charge on the photosensitive drum 103, transfer bias of the transfer roller and the like.

The printer engine part 350 includes the fixing part 110, the driving part 351, a first sensor part 352, the paper feeding control part 353, the high voltage control part 354, a second sensor part 355 and the like. The second sensor part 355 is a temperature sensor, a humidity sensor, a sensor for detecting available toner amount or the like.

Figure 4:
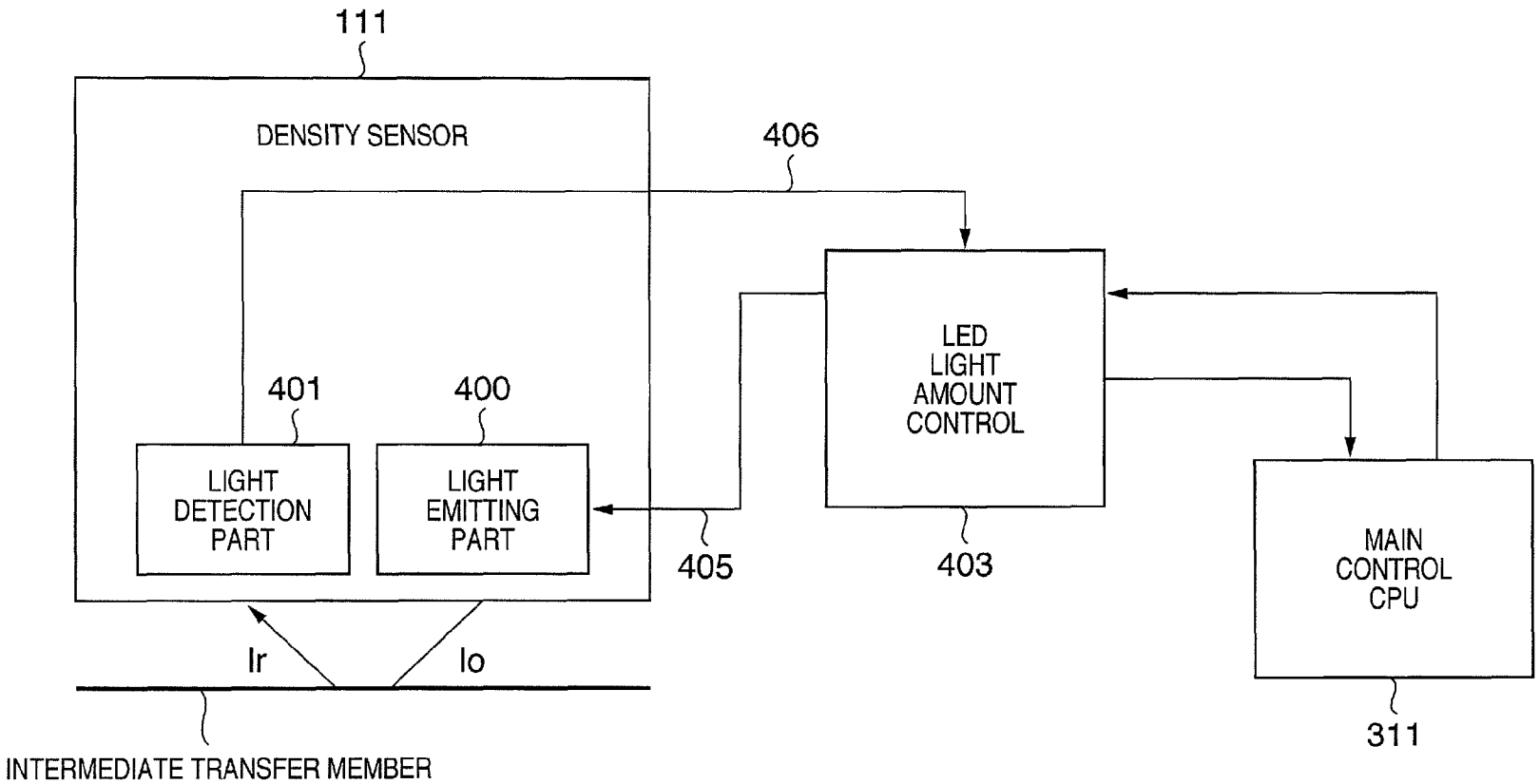
FIG. 4 is an example of a density sensor according to an embodiment.

FIG. 4 is an example of a density sensor according to an embodiment. The density sensor 111 is intended to be included in the second sensor part 355. The density sensor 111 is made of a light emitting part 400 such as an LED (Light Emitting Diode) and a light detection part 401 such as a PD (PhotoDetector). Light Io illuminated from the light emitting part 400 to the intermediate transfer member 106 is reflected on the surface of the intermediate transfer member 106. The reflected light Ir is received at the light detection part 401, which outputs received light amount 406.

The amount of the reflected light Io measured at the light detection part 401 is monitored at an LED light amount control part 403. Further, the LED light amount control part 403 notifies the main control CPU 311 of the amount of the reflected light Io. The main control CPU 311 calculates patch image density based on luminous intensity 405 of illumination light Io and received light amount 406 (measured value) of the reflected light Ir.

This density sensor 111 is used for control to stabilize tone of the formed image. That is, the density sensor 111 detects a patch image formed on the intermediate transfer member 106 experimentally.

A representative of stability control is Dmax control and halftone control (see Japanese Patent Application Laid-Open No. 07-92385). In the so-called Dmax control, a plurality of color material image is formed experimentally while varying the amount of exposure, development voltage and electrification voltage. The density of each generated color material image is measured, and based on the measured value, the amount of exposure, development voltage and electrification voltage values corresponding to target density of each color are calculated.

On the other hand, in the halftone control, for example, the amount of exposure, development voltage and electrification voltage values calculated by Dmax control are used. Color material images at several steps for which halftone process such as screen is performed are generated experimentally. The density of the generated color material images is measured, and based on the measured density, γLUT (Gamma Look-Up Table) is generated. The γLUT is a table for correcting the relation between input and output signals in order for the output result with respect to the input signal to satisfy target density characteristic. This γLUT is saved in the image processing GA 312 and used for forming a next image.

An image data such as 1 Bit Tiff halftone-dots processed in a user's PC or other server in advance may be inputted to the printer 100. According to the present embodiment, the image processing GA 312 performs image forming for such halftone-processed image data without performing further halftone process. As described above, the halftone-processed image data can not be reflected on the γLUT.

According to the present embodiment, the halftone identifying part 206 included in the controller part 200 identifies a process parameter of a halftone process which has been performed for an input image data in advance, and forms a patch image by applying the halftone process according to the identified process parameter. Then the density of the formed patch image is detected, and image forming conditions are adjusted according to the detected density.

[Detailed Determination Process]

Figure 5:
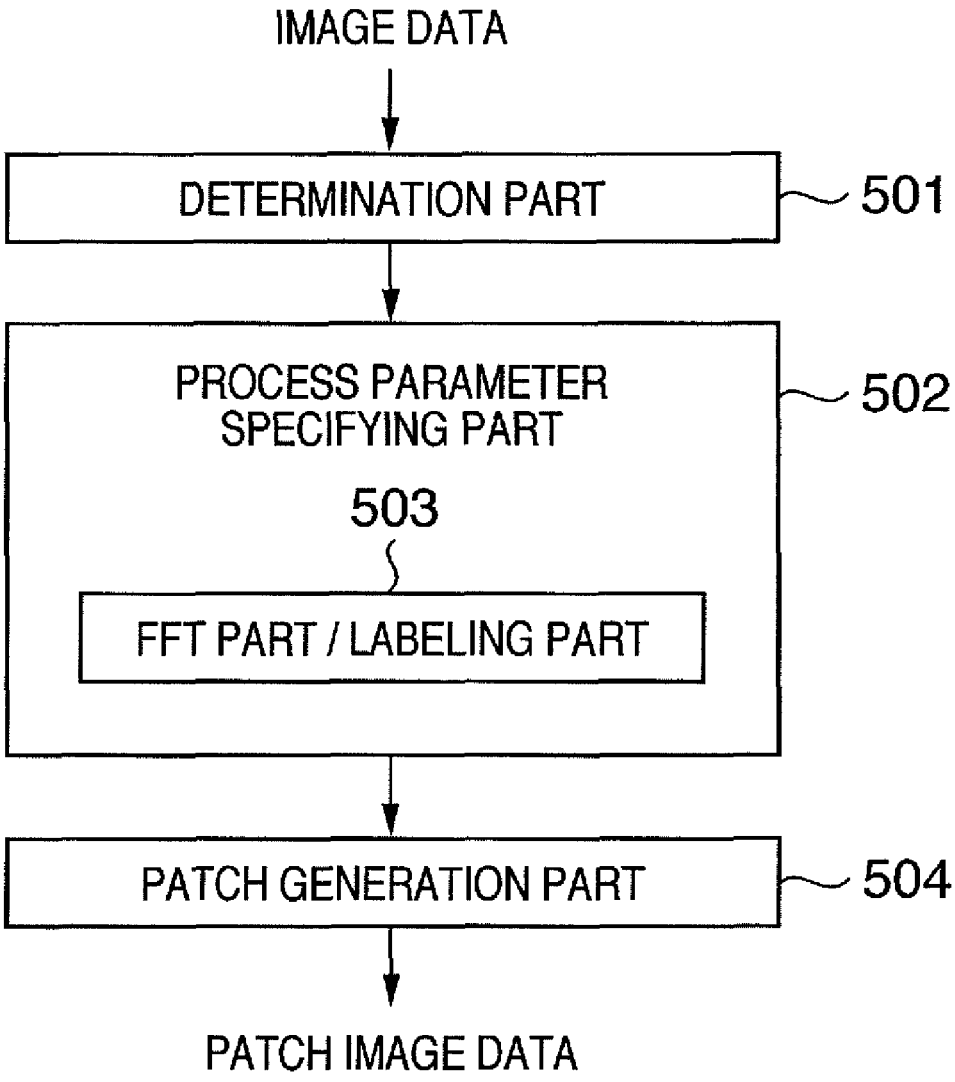
FIG. 5 is an exemplary block diagram of a halftone identifying part according to an embodiment.

FIG. 5 is an exemplary block diagram of a halftone identifying part according to an embodiment. A determination part 501 determines whether or not halftone process is performed for an image data inputted via the interface part 205 in advance. For example, based on a frequency information in the image data, the process parameter specifying part 502 specifies the content of the halftone process which is performed for the image data. A FFT/labeling part 503 acquires the frequency information by performing two-dimensional Fourier transformation for the image data. Instead of the FFT/LABELING PART 503, a labeling part which is described below may also be employed. A patch generation part 504 generates a patch image data by applying a halftone process according to the specified process parameter. The patch image is finally visualized on an image carrier (the intermediate transfer member 106) as a color material image.

With reference to a tag attached to the image data, the determination part 501 determines whether it is an image data (photograph, bitmap based), a text data or a graphic data such as a line drawing. For example, with reference to a PDL code, the type of the data can be easily identified. If the controller part 200 can directly input an image data such as Tiff or Bitmap, the type of the data can be identified by file extension, header information or the like.

In this way, by determining whether there is a bitmap image, processing speed can be increased. That is, for an input data not including any bitmap image, frequency analysis is not needed. Therefore, if the frequency analysis which is time consuming for processing can be skipped, the processing speed for the entire image forming process will be increased.

Further, the determination part 501 determines whether or not the halftone process is performed for the image data in advance. The process parameter specifying part 502 acquires frequency characteristic of the image data. The process parameter specifying part 502, for example, performs frequency analysis for the inputted image using two-dimensional FFT(Fast Fourier transformation). This enables the halftone pattern to be detected. Two-dimensional FFT is known to those skilled in the art, and therefore not described in detail.

Figure 6:
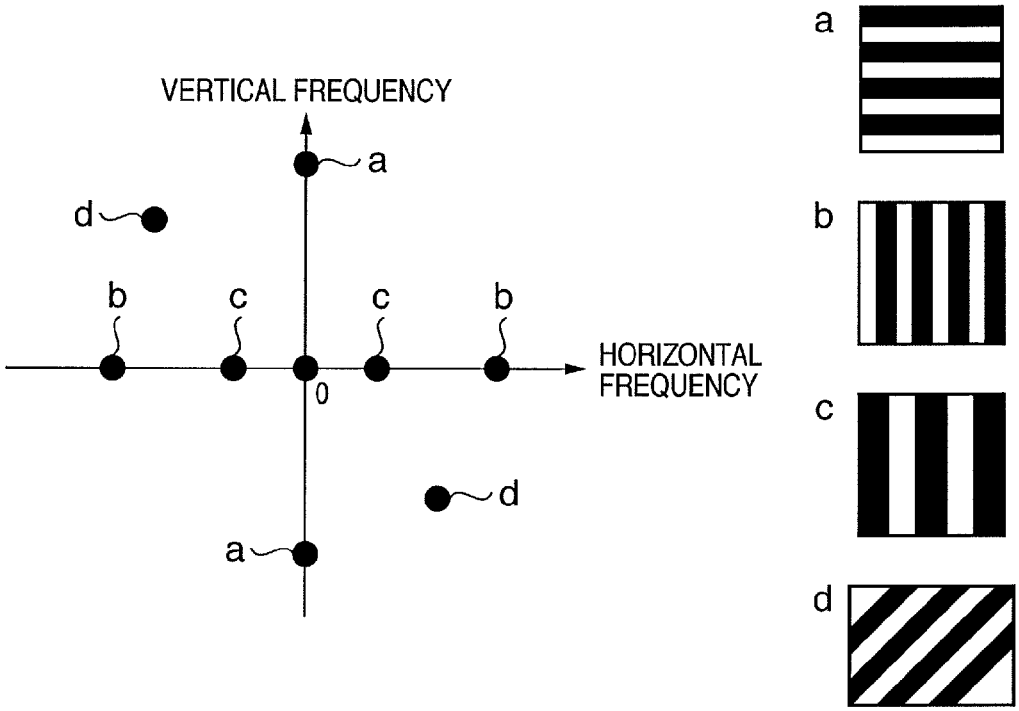
FIG. 6 is a conceptual diagram showing the result of two-dimensional FFT analysis.

FIG. 6 is a conceptual diagram showing the result of two-dimensional FFT analysis. Abscissa shows horizontal frequency and ordinate shows perpendicular frequency. (a)-(d) show representative halftone patterns. The analysis results of two-dimensional FFT corresponding to the halftone pattern in (a)-(d) are also labeled as (a)-(d). In both ordinate and abscissa, frequencies are increased with distance from origin. Higher frequency means that the number of lines is increased in the halftone process.

The screen angle can be identified using two-dimensional FFT analysis. As shown in FIG. 6, if peak occurs in the direction of 45 degree from origin, pattern becomes oblique line pattern (d). In FIG. 6, illustration is made using lines. However, if there is a similar peak in the direction with which a line passing through a peak and origin forms 90 degree, a growing scheme of halftone becomes dot growing scheme.

In this way, a process parameter of halftone (e.g., the number of lines, angle, growing scheme (line growing or dot growing)) can be identified through frequency analysis.

Figure 7A:
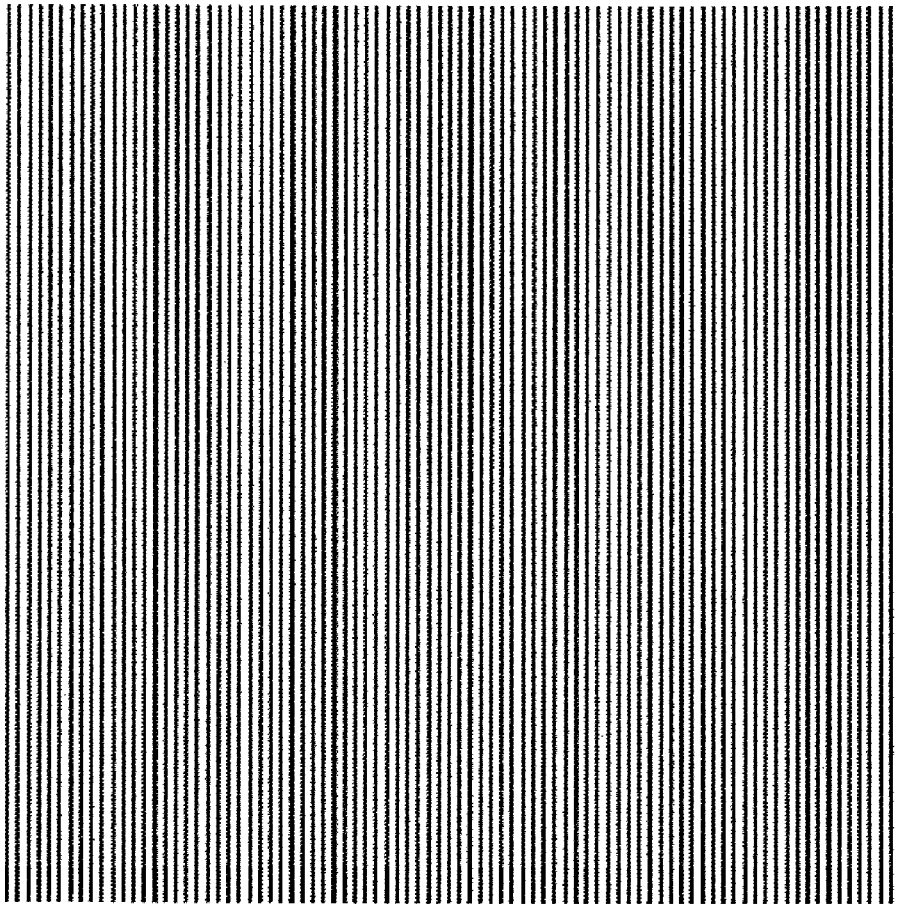
FIG. 7A is a real image in 200 lpi.
Figure 7B:
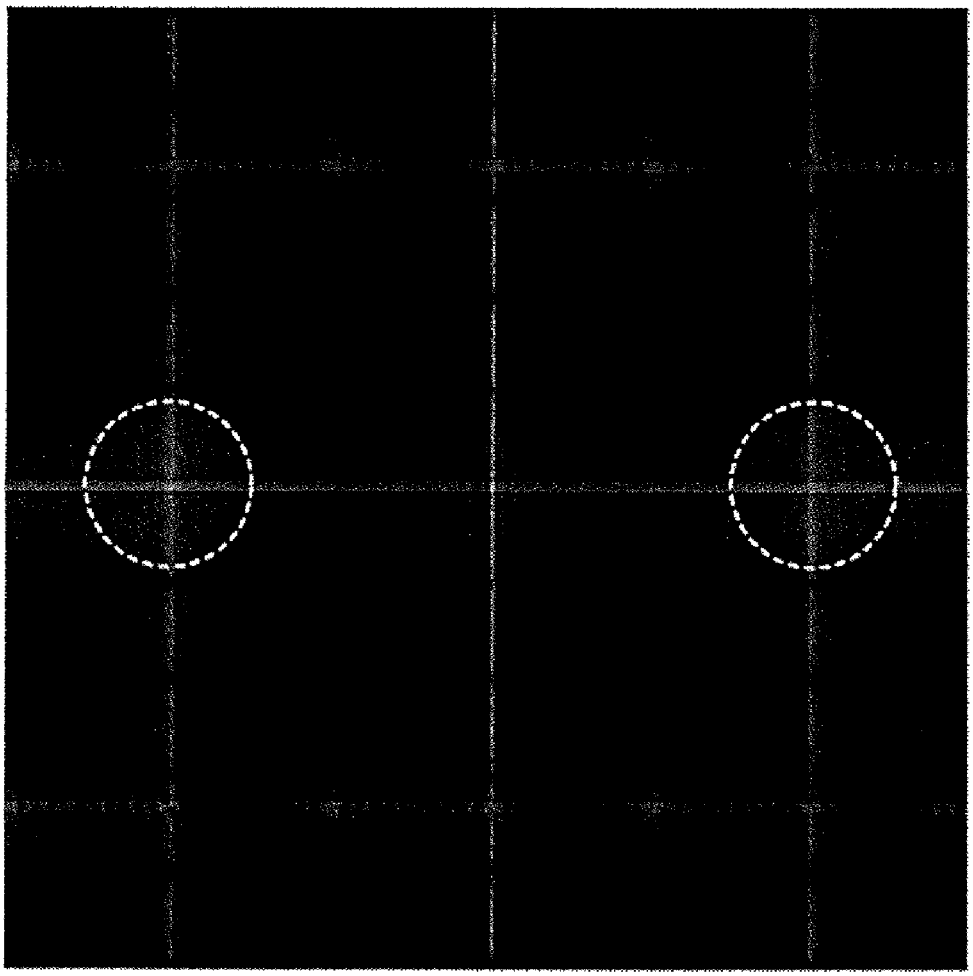
FIG. 7B is a gray-scale image representing amplitude characteristic resulting from two-dimensional FFT transformation of the real image in 200 lpi.
Figure 7C:
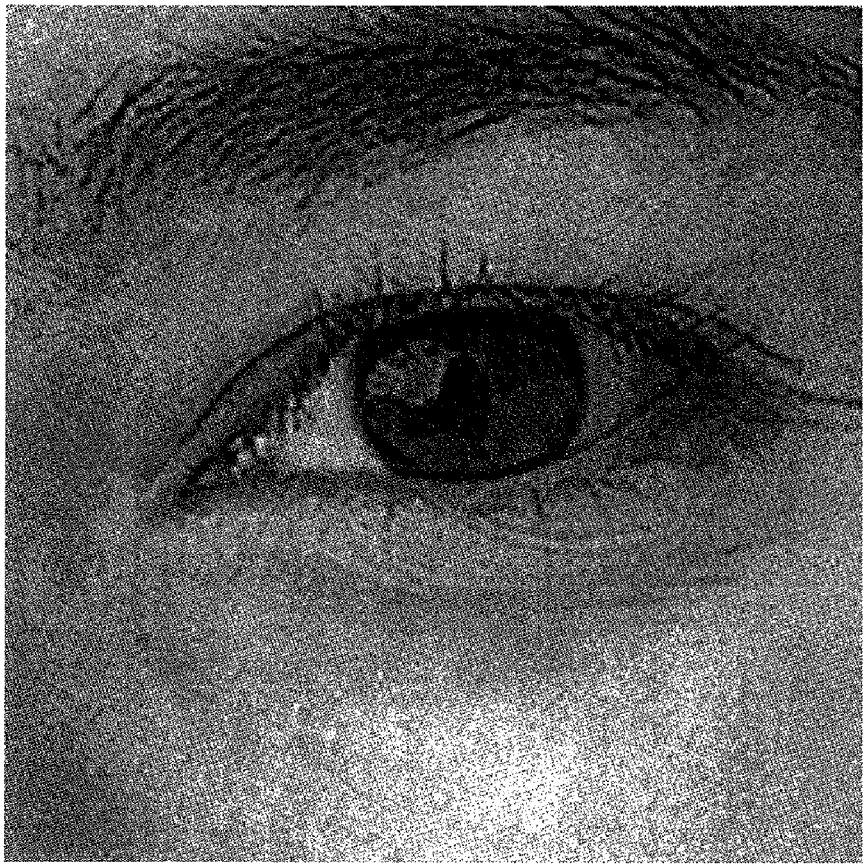
FIG. 7C is a real image of the periphery of a human eye.
Figure 7D:
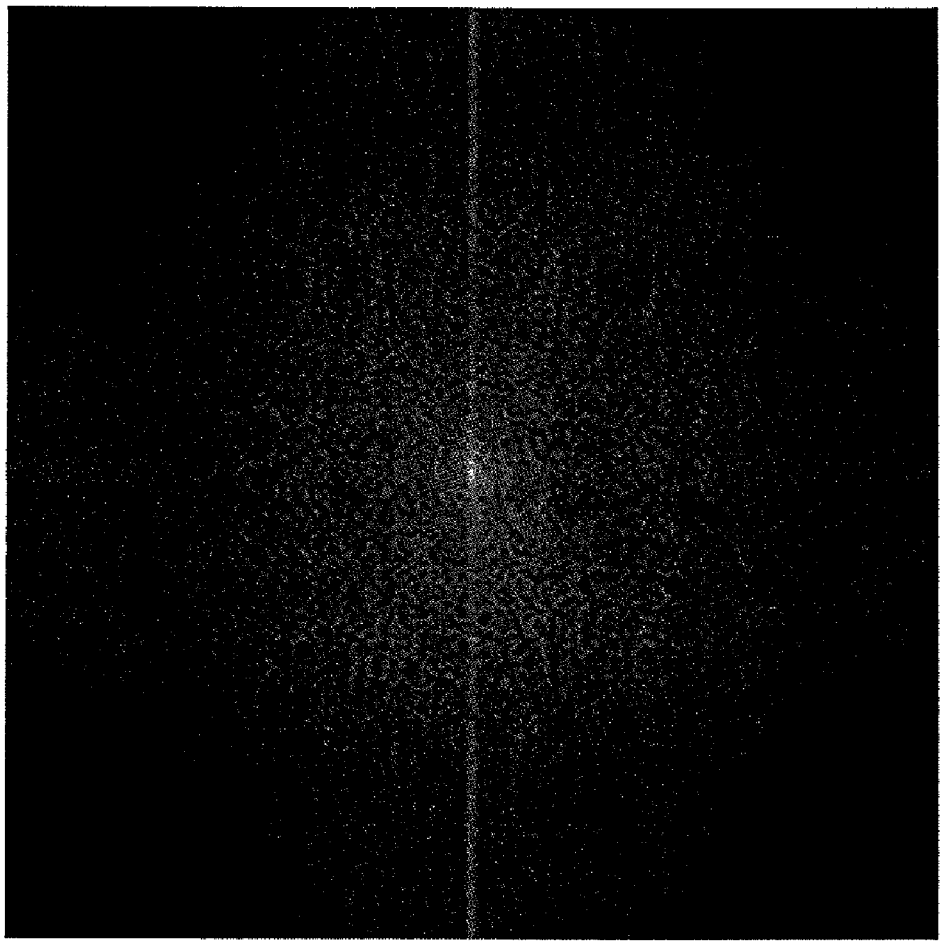
FIG. 7D is a gray-scale image representing amplitude characteristic resulting from two-dimensional FFT transformation of the real image of the periphery of the human eye.

FIG. 7A is a real image in 200 lpi. FIG. 7B is a gray-scale image representing amplitude characteristic resulting from two-dimensional FFT transformation of the real image in 200 lpi. FIG. 7C is a real image of the periphery of a human eye. FIG. 7D is a gray-scale image representing amplitude characteristic resulting from two-dimensional FFT transformation of the real image of the periphery of the human eye.

The result of frequency analysis in FIG. 7B shows that the real image in 200 lpi (FIG. 7A) includes periodic pattern, because there is two peaks on horizontal frequency axis. With reference to FIG. 7D, it can be seen that there is no peak in human image (FIG. 7C) except for the center. Therefore, these characteristics can be employed to identify halftone pattern.

According to the present embodiment, the determination part 501 extracts peaks where amplitude becomes highest. In FIG. 7B, the peaks are within dotted circles. Of course, the number of lines which is actual frequency can be calculated using the extracted peak position and the distance from the center.

[Patch Generation]

Next, patch generation method will be described. A patch generation part 504 in the halftone identifying part 206 applies halftone process having substantially the same content as the specified halftone process to the content of the specified halftone process to form a halftone patch image. For example, a patch image data is added after the inputted image data and it is outputted to the engine control part 300.

FIG. 8 is the relation among base resolution, number of lines, and angle. According to the present embodiment, as an example, base resolution is 2400 dpi. Where the base resolution means write resolution at the printer engine part. The reason for setting the base resolution to 2400 dpi is that total balance of processing speed and image quality becomes good.

In FIG. 8, horizontal and vertical scanning pixel period represent dot period respectively. That is, in frequency analysis result, when a next dot appears at a position which is X and Y pixels away from a dot in horizontal and vertical scanning direction respectively, the number of lines (LPI<Line/Inch>) and angle can be obtained from the table shown in FIG. 8. For example, when the next dot appears at a position which is 8 and 10 pixels away from a dot in horizontal and vertical scanning direction respectively, it can be seen from the table in FIG. 8 that the number of lines is 187. For example, by storing this table into ROM 202 or HDD 204, this table can be referenced from the halftone identifying part 206.

The patch generation part 504 generates a square patch having size of 2 cm×2 cm, for example, based on the information obtained from the table in FIG. 8. For example, the patch is generated such that its filled area ratio is about 30%. Of course, 100% is defined as the state in which the entire area is filled.

The reason for setting area ratio to 30% is that a highlighted portion and a halftone portion are more noticeable than a high density portion under equal density variation. Further, when verified in an experimental device, it is found that area ratio of 30% is in a region where density characteristic is unstable. The area ratio is not necessarily limited to 30%, because area ratio should be appropriately modified depending on the developing device size and scheme, color material characteristic and the like. However, considering the sensitivity of eye, the area ratio of 20-80% will be appropriate.

Next, a method of generating a patch filled that its filled area ratio is 30% will be described. Of course, the area ratio may be other values.

The patch generation part 504 generates a dither matrix based on the process parameter (the number of screen lines, angle and growing scheme) specified by the specifying part 502. The dither matrix is a kind of transformation matrix representing what kind of halftone dots the inputted image data is reproduced as. Specifically, the number of lines identifies dot interval. The angle identifies halftone dots arrangement (periodic pattern). At this point, appearance of the dither matrix can be identified. Growing scheme (i.e., dot growth or line growth) identifies filling order within the dither matrix. Through these processes, halftone dots pattern is finally generated.

Figure 9:
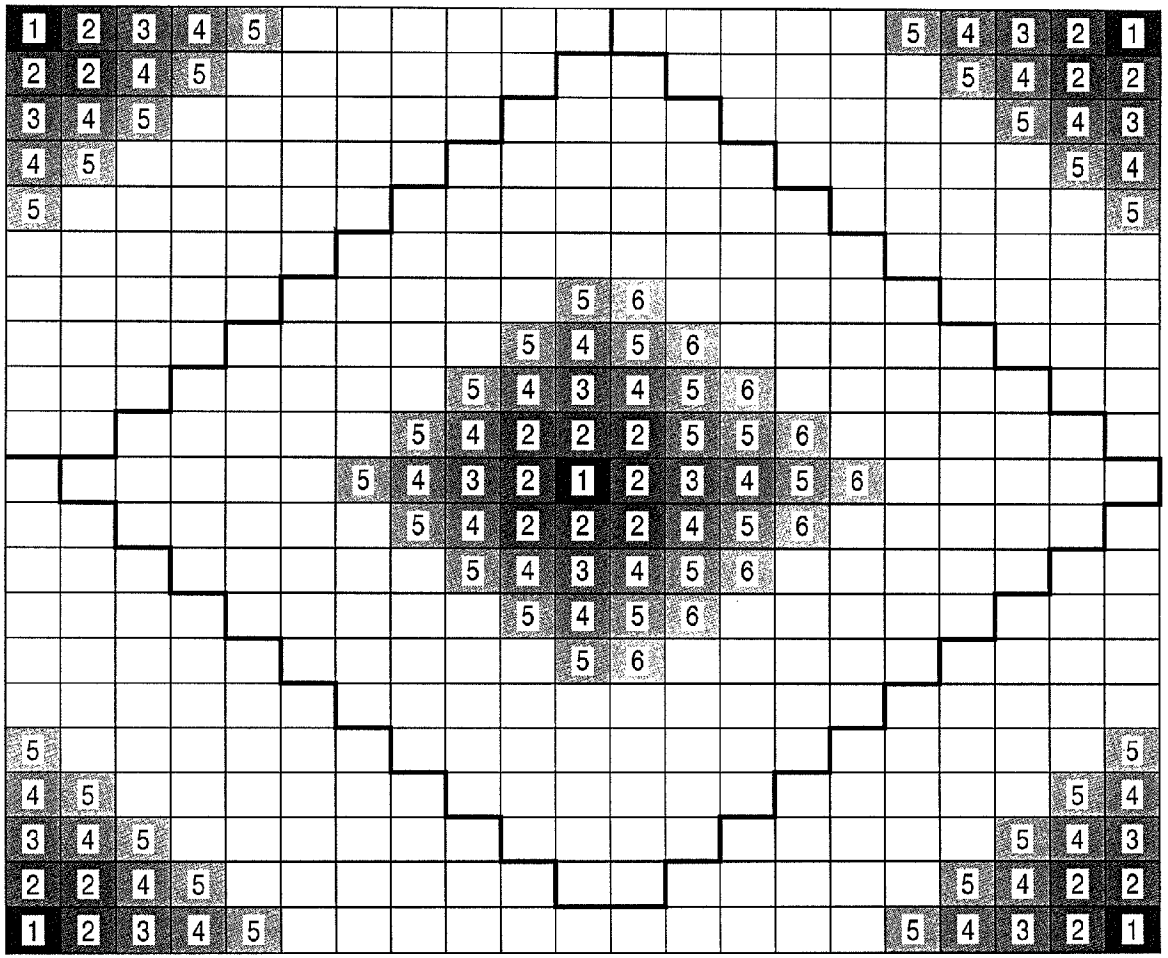
FIG. 9 is an example of 30% fill pattern using a generated dither matrix.

FIG. 9 is an example of 30% fill pattern using the generated dither matrix. Here, 170 lines (LPI) and 45 degree halftone dots pattern, which is often used for black (BK) in offset printing, is described as an example. Such halftone dots pattern is represented in the table in FIG. 8 as a halftone dots pattern having dot intervals of 10 and 10 pixels in horizontal and vertical scanning directions respectively. Since growing scheme is dot growth, filling order is round dot (the order such that a base point is surrounded). The patch generation part 504 stops the growth when the ratio of the number of pixels in the dither matrix to the number of filled pixels becomes 30%. The patch generated in this way is added to the rear of the input image and is outputted to the engine control part 300.

It will be desirable to store into the ROM 202 or the HDD 204 what kind of the dither matrix is generated for each pair of the number of lines and angle in advance, because once registration is performed in advance, calculation process of dither matrix can be skipped.

The filling order is the order such that rhombus, rectangular, circular or approximately line pattern is drawn with respect to the base point. Therefore, the filling rule may be computer programmed and stored. A dither pattern according to each filling order may also be stored in the ROM 202 or the like in advance.

[Stability Control]

Figure 10:
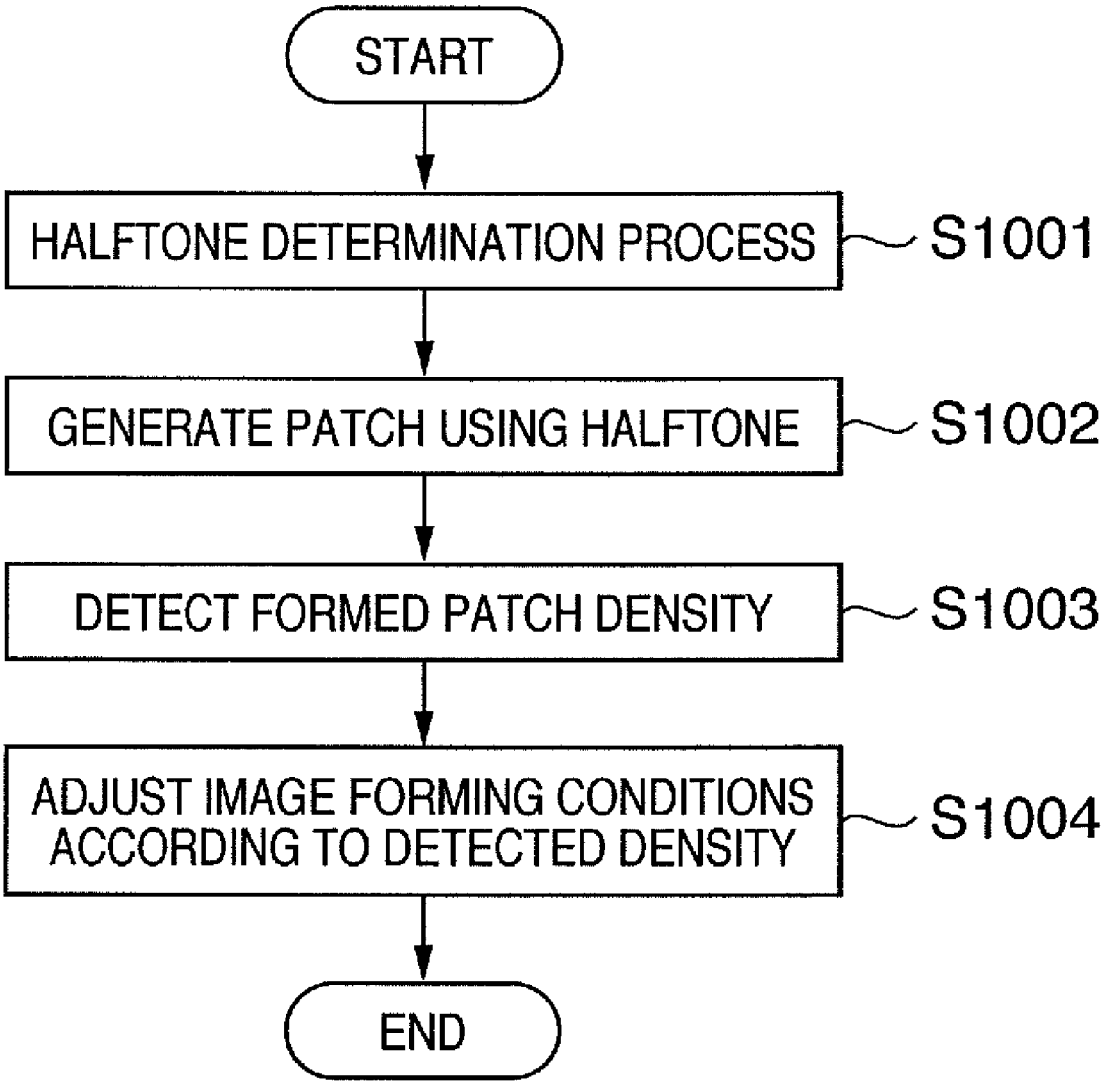
FIG. 10 is an exemplary flow chart for stability control according to an embodiment.

FIG. 10 is an exemplary flow chart for stability control according to an embodiment. In step S1001, the halftone identifying part 206 identifies the process parameter in the halftone process which has been previously performed for the inputted image data. Particular example of determination method has been described above. For example, the process parameter specifying part 502 in the halftone identifying part 206 specifies the number of screen lines and the like by performing frequency analysis for the input image data.

In step S1002, the halftone identifying part 206 generates a patch data by applying the halftone process according to the identified process parameter. For example, a 30% patch data is generated depending on the number of screen lines specified by the process parameter specifying part 502. This patch data is sent to the engine control part 300. The CPU 311 in the engine control part 300 controls the light emitting part 101, developing device 104, 105, photosensitive drum 103 and intermediate transfer member 106 based on the patch data and forms a patch image by color material.

In step S1003, the CPU 311 detects the density of the patch image by the density sensor 111 in the sensor part 335.

In step S1004, the CPU 311 adjusts image forming conditions (the amount of exposure of light emitting part 101 or the like) depending on the density of the detected patch image. The adjusted image forming conditions is validly applied at next image forming. That is, the CPU 311 stores the first detected density into a memory or the like, and depending on the difference ΔD between the stored density and the densities detected for each of second or later image forming (density difference), image forming conditions used for next image forming is modified.

Figure 11:
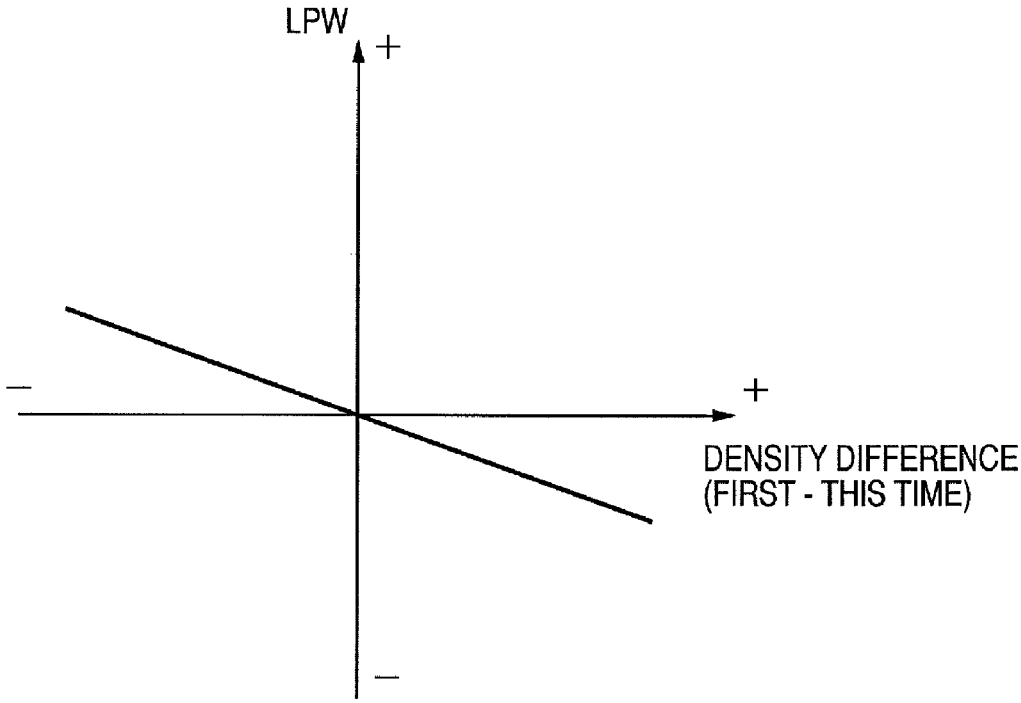
FIG. 11 is the relation between density difference and luminous intensity according to an embodiment.

FIG. 11 is the relation between density difference and luminous intensity according to an embodiment. Here, description is made such that the amount of exposure is controlled by the luminous intensity. As apparent from this figure, if the density difference is positive, the luminous intensity is adjusted to be decreased. On the other hand, if the density difference is negative, the luminous intensity is adjusted to be increased.

It is desirable that the patch image is positioned on the intermediate transfer member 106 to be positioned outside the paper size, because the patch image is prevented to be transferred on the transfer material P.

The patch image is formed on the intermediate transfer member 106 for each color material (e.g., C, M, Y, K) and detected by the density sensor 111. Of course, the patch image for each color material is formed such that they do not overlap.

As described above, according to the present embodiment, applying a halftone process having substantially the same content as the halftone process which has been previously performed for the inputted image data, a patch image is generated. Then the image forming conditions is adjusted depending on the density of this patch image. This enables the image forming conditions to be appropriately adjusted even if the halftone-processed image data is inputted.

For example, the content of the halftone process can be specified in terms of at least one of screen frequency, screen angle and dot growing scheme found by frequency analysis of the input image data.

The frequency analysis also has the advantage that it is easily provided because two-dimensional Fourier transformation well-known in the art can be used.

However, since two-dimensional Fourier transformation requires relatively longer processing time, it is desirable to skip two-dimensional Fourier transformation when the data for printing is not an image data. Of course, skipping two-dimensional Fourier transformation reduces the processing time for image forming.

Second Embodiment

Figure 12:
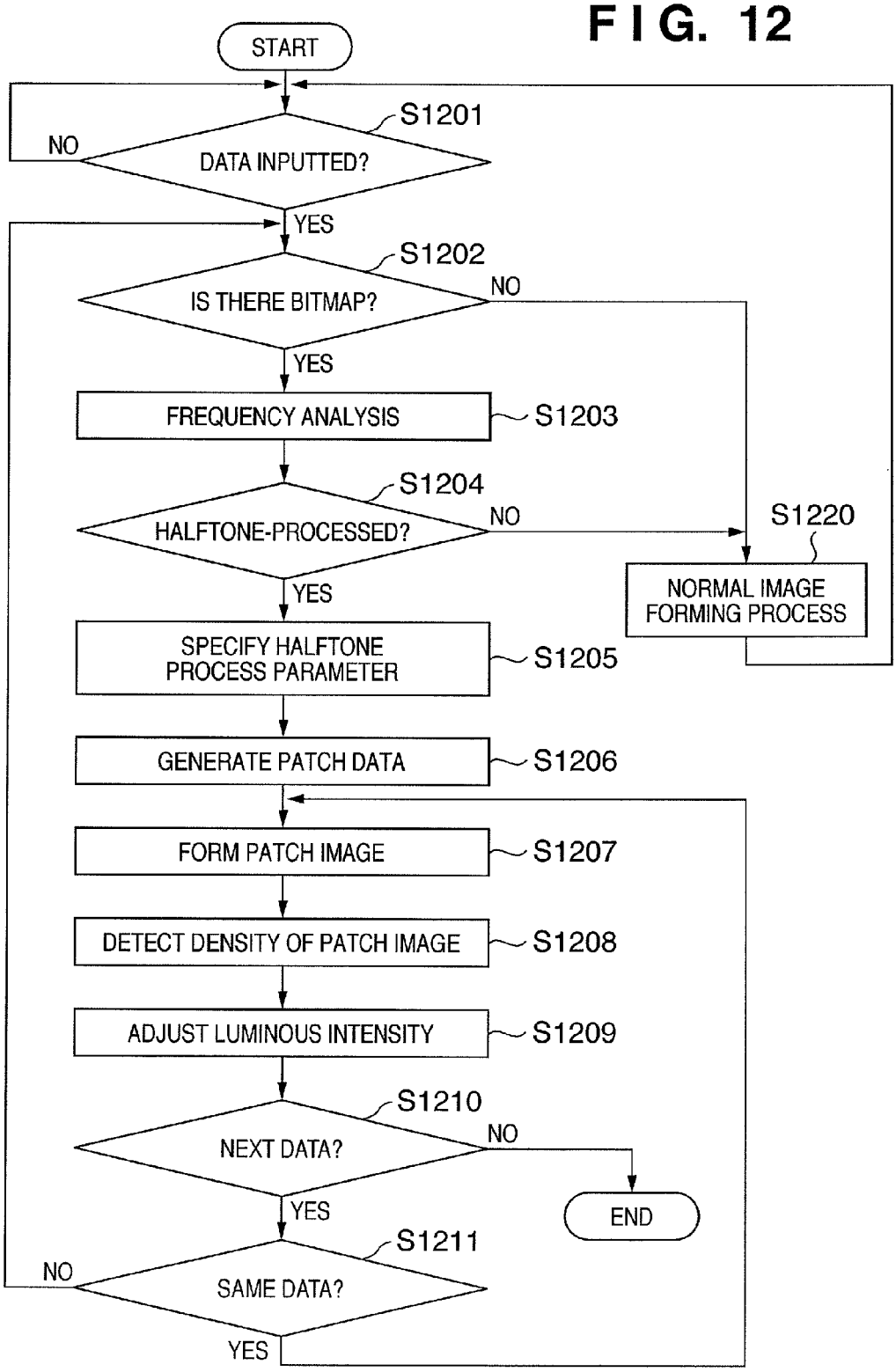
FIG. 12 is a detailed and exemplary flow chart for stability control according to a second embodiment.

FIG. 12 is a detailed and exemplary flow chart for stability control according to a second embodiment. In the present embodiment, a more detailed example for stability control is described.

In step S1201, The CPU 201 in the controller part 200 determines whether or not the data for printing generated at a PC or another server is inputted through the interface part 205. If the data for printing is inputted, the process proceeds to step S1202.

In step S1202, the CPU 201 determines whether there is a bitmap image in the inputted data using the halftone identifying part 206. If there is not a bitmap image in the data for printing, for example it is a normal text data, the process proceeds to step S1220, where the CPU 201 performs a normal image forming process. The normal image forming process refers to an image forming process in which stability control (adjustment of image forming conditions) according to the present embodiment is skipped. When the normal image forming process is performed, the CPU 201 may also perform conventional stability control such as γLUT or Dmax control.

On the other hand, if the presence of bitmap is detected, the process proceeds to step S1203, where the halftone identifying part 206 performs the frequency analysis described above.

In step S1204, the halftone identifying part 206 determines whether or not the inputted image data is a halftone-processed image data based on the result of the frequency analysis. If it is not halftone-processed, the process proceeds to step S1220, where the CPU 201 performs the normal image forming process.

On the other hand, it is halftone-processed, the process proceeds to step S1205, where the halftone identifying part 206 specifies the halftone process parameter based on the result of the frequency analysis.

In step S1206, the halftone identifying part 206 generates a patch data depending on the content of the specified halftone process. The patch data is a data for acquiring a patch image. This patch data is subject to color transformation process in a color transformation part 208 in conjunction with the image data for printing, and is outputted from the printer interface control part 210 to an engine control part 300. The patch image will be added to the rear of the inputted image.

In step S1207, the CPU 311 in the engine control part 300 sends an image signal received through the video interface 301 to the image processing GA 312. The image processing GA 312 performs a predetermined image process for the image signal and outputs the result to the image forming part 313. The image forming part 313 controls the luminous intensity of laser in response to the image signal and the printer engine part 350 forms the image for printing and the patch image on the intermediate transfer member 106.

In step S1208, the CPU 311 detects the density (the amount of color material) of the formed patch image using a density sensor 111 included in the sensor part 355.

In step S1209, the luminous intensity of the light emitting part 101 is adjusted depending on the density of the detected patch image. More particularly, the CPU 311 reads the previously detected density Dx from the memory or the like, and calculates the difference ΔD between Dx and the density detected at this time (density difference). Depending on this density difference ΔD, the luminous intensity of laser (LPW) used in the next image formation is modified.

In step S1210, the CPU 201 in the controller part 200 determines whether or not there is the next data for printing. If there is not the next data for printing, the CPU 201 completes this process. On the other hand, if there is the next data, the CPU 201 proceeds to step S1211, and determines whether or not the next data for printing is the same as the current data for printing. For example, if multiple printing of the same image is indicated, the CPU 201 determines that it is the same data for printing.

As described above, according to the present embodiment, the amount of exposure which is one of the image forming conditions can be adjusted by the luminous intensity of laser.

If the inputted data for printing does not include a bitmap image, a normal image forming operation is performed, so that processing speed is increased.

Further, if the same image data performs image forming successively, the density of the formed image can be stabilized since the density of a patch image can be detected over multiple times using the same patch image.

Third Embodiment

In the second embodiment, the example of primarily adjusting the luminous intensity of laser (LPW) depending on the density of the patch image has been described. Typically, in order to change LPW, it is required to change bias. Therefore, when bias is switched for each color with respect to light emission of laser, response time for switching may decrease processing speed. Cost may also be increased.

In a third embodiment, an example of adjusting light emission duration of laser by controlling the pulse width of an image signal inputted to the laser will be described. In general, PWM (pulse width modulation) scheme is applied to the light emitting part 101. Therefore, adjusting light emission duration of laser has an advantage over adjusting luminous intensity of laser in that it is relatively easy to provide it.

In PWM scheme, since light emission duration at a place where there is a dot can be changed even in a binary image, similar effect as controlling luminous intensity is obtained. As described in Japanese Patent Application Laid-Open No. 2000-131890, PWM scheme is a technology in which a halftone image is generated by controlling light emission duration.

A flow chart of stability control according to the third embodiment is substantially same as FIG. 12, and therefore not described. Particularly, the modification process of luminous intensity at step S1209 is changed to a change process of light emission duration.

According to the present embodiment, since the amount of exposure can be adjusted by controlling light emission duration of laser, it is more feasible than the second embodiment. That is, the third embodiment is relatively advantageous in terms of response time and cost.

Fourth Embodiment

In the above-described embodiment, two-dimensional Fourier transformation is employed for determining the halftone process. However, the present invention is not limited to the frequency analysis using two-dimensional Fourier transformation. Any scheme may of course be employed as long as the content of the halftone process can be identified.

The frequency analysis process using two-dimensional Fourier transformation described above requires relatively high operation speed and relatively large memory capacity. These undesirably cause cost to be increased.

In a fourth embodiment, more simple scheme (labeling scheme) for determining the content of halftone process is proposed.

The labeling scheme is a scheme for labeling the same label for concatenated pixels in an inputted bitmap image. For example, if two white pixels at the same level are concatenated, the same label is assigned to these pixels.

Figure 13:
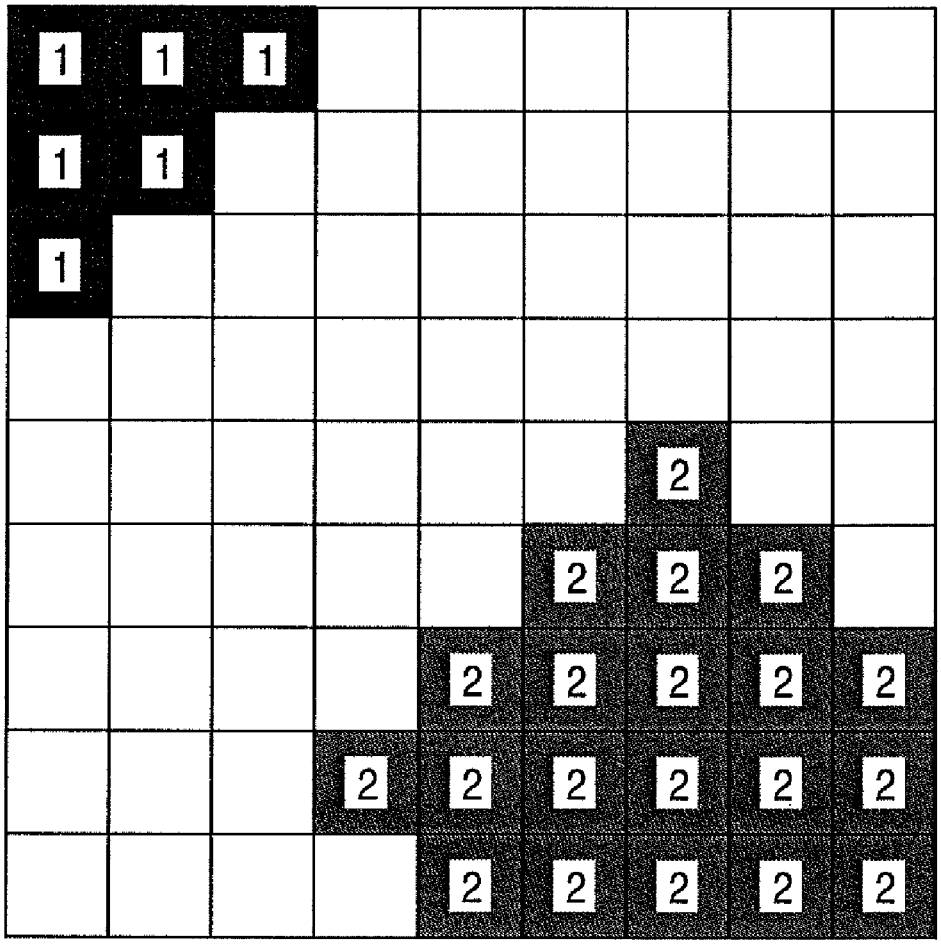
FIG. 13 is a conceptual diagram showing a labeling scheme according to an embodiment.

FIG. 13 is a conceptual diagram showing a labeling scheme according to an embodiment. It will be understood that the same label "1" or "2" is assigned to concatenated pixels.

Figure 14:
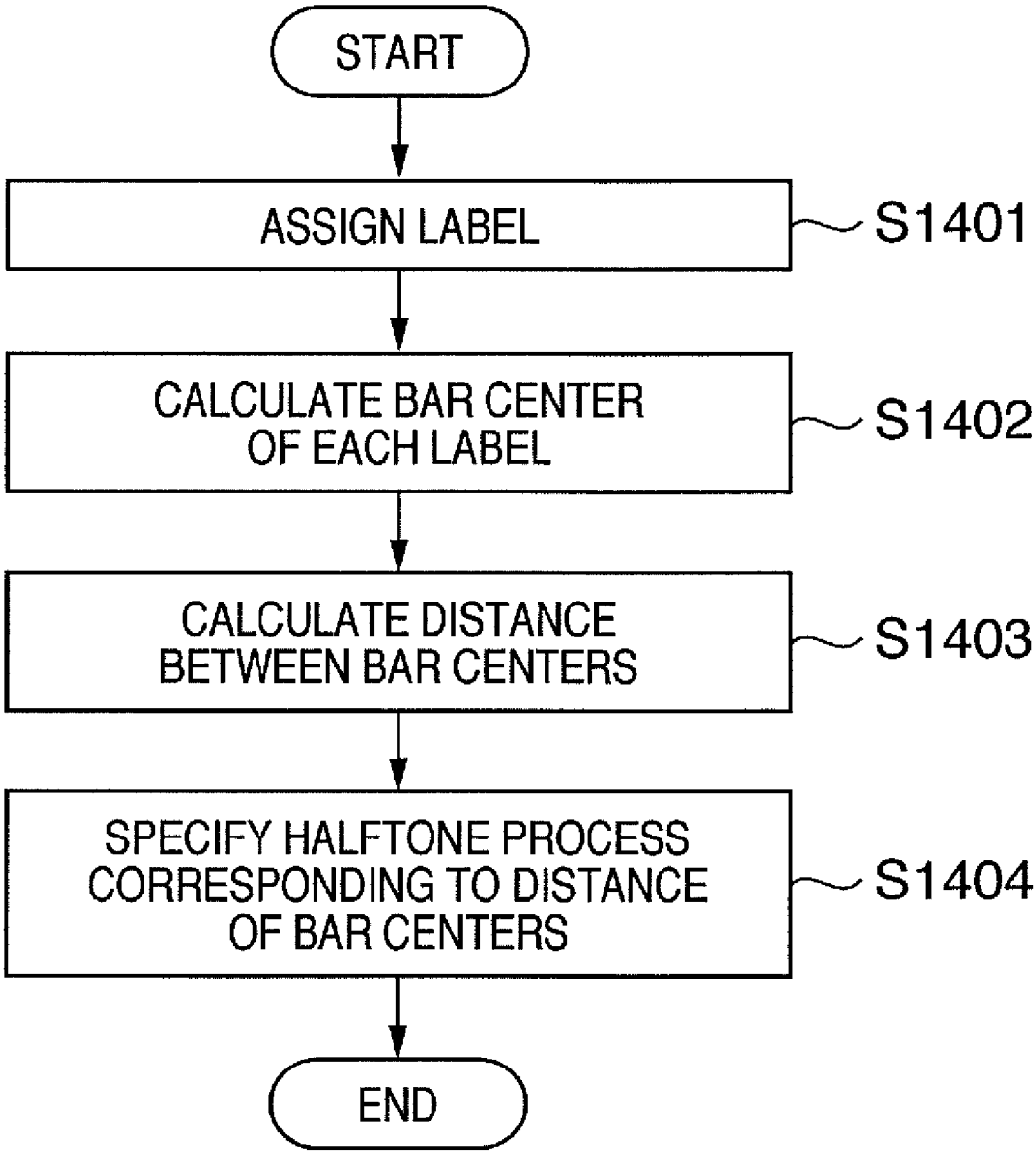
FIG. 14 is an exemplary flow chart showing a halftone determination method in a labeling scheme according to a fourth embodiment.

FIG. 14 is an exemplary flow chart showing a halftone determination method in the labeling scheme according to the fourth embodiment. A process according to the present flow chart corresponds to step S1001 in FIG. 10 or S1203 and S1205 in FIG. 12.

In step S1401, a FFT/labeling part 503 in the halftone identifying part 206 assigns a label to concatenated pixels included in the inputted image data.

In step S1402, the FFT/labeling part 503 calculates the barycentric position of each label. An example of a formula for calculating barycentric coordinates is written as:

$$\left(\frac{1}{n}\sum_{i=0}^{n-1} xi,\ \frac{1}{n}\sum_{i=0}^{n-1} yi\right)$$

where (xi, yi) denotes coordinates for each pixel to which the same label is assigned. i is a integer between 0 and n−1. n is the number of previous pixels.

In step S1403, the FFT/labeling part 503 calculates the distance between the plurality of calculated the barycentric position (space between the barycentric positions).

In step S1404, the process parameter specifying part 502 specifies from a table provided in advance the content of halftone process corresponding to the calculated space between the barycentric positions. This table is similar to that shown in FIG. 8, and is intended to manage space between the barycentric positions and the corresponding content of the halftone process (the number of lines, angle, etc.).

As described above, according to the present embodiment, the present invention can be realized more easily than the two-dimensional Fourier transformation scheme, since the content of the halftone process can be specified by applying the labeling scheme. Among other things, requirements such as operation speed and memory capacity is relatively reduced, therefore the present embodiment is advantageous in terms of cost.

Fifth Embodiment

In the above-described embodiment, the description has been made such that the image processing conditions is changed unless the difference ΔD between the previously detected density and the density detected at this time is zero. However, the present invention is not so limited.

Figure 15:
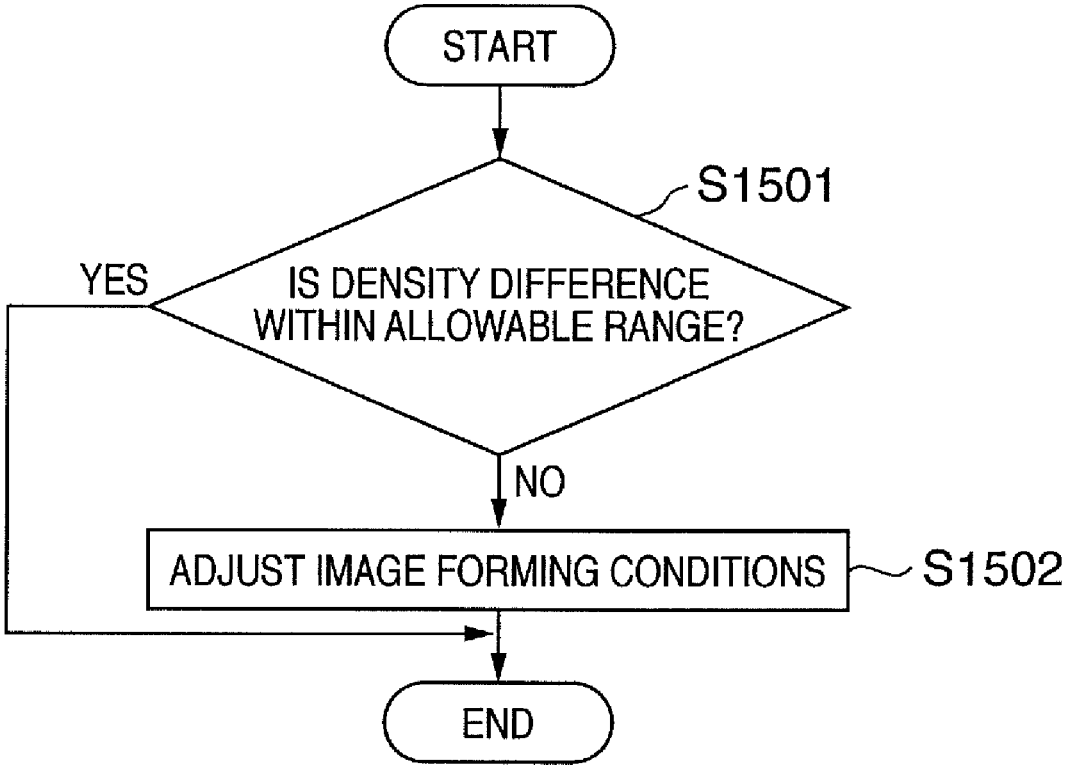
FIG. 15 is a flow chart for adjusting image processing conditions according to an embodiment.

FIG. 15 is a flow chart for adjusting image processing conditions according to an embodiment. This flow chart corresponds to step S1004 and step S1209 described above.

In step S5101, the CPU 311 in the engine control part 300 compares the density difference ΔD with a predetermined allowable range. If the density difference ΔD is within the predetermined allowable range, the CPU 311 skips adjusting the image processing conditions. On the other hand, if the density difference ΔD is not within the predetermined allowable range, the CPU 311 proceeds to step S1502, and performs the process for adjusting the image forming conditions.

An experiment for the present embodiment showed that when the density difference exceeds 10%, it exceeds the allowable range. Therefore, if the density difference is 10% or lower, it is within allowable range and the image forming conditions is not changed.

However, 10% is not absolute value, because the density difference which is within the allowable range is different depending on the color material content, covering power, spectral reflectivity characteristic and the like. Therefore, it is desirable that the allowable range is determined for each device from experiment or the like.

In this way, the present embodiment has an advantage that unneeded adjustment processes can be skipped by adjusting the image processing conditions only if the density difference is not within the allowable range.

Other Embodiment

Although the printer 100 is used as an example of the image forming apparatus in the present embodiment, the present invention is not so limited. Of course, the present invention may be similarly applied to, for example, a copying device, a multiple function device and a facsimile machine.

Of course, the processing according to each flow chart described above may be provided as a computer program (e.g., firmware).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-254006, filed Sep. 1, 2005, which is hereby incorporated by reference herein in its entirety.

What is claimed is:

1. An image forming apparatus comprising:

a scanner including a light emitting part configured to emit a light based on image data to form an electrostatic latent image on an image bearing member;

an identifying unit which identifies a process parameter of a halftone process which is applied to the image data which has a binary data and input from a personal computer or other controller, wherein said identifying unit identifies said process parameter of said halftone process in terms of at least one of screen frequency, screen angle, or dot growing scheme;

a forming unit which forms a patch image by applying said halftone process according to said identified process parameter;

a detecting unit which detects the density of said formed patch image; and an adjustment unit which adjusts the amount of exposure of light emitted from the light emitting part according to said density of said detected patch image.

2. The image forming apparatus according to claim 1, wherein said identifying unit identifies said process parameter of said halftone process based on the result of the transformation obtained from performing two-dimensional Fourier transformation of the image data.

3. The image forming apparatus according to claim 2, wherein said identifying unit skips performing said two-dimensional Fourier transformation when data for printing is not image data.

4. The image forming apparatus according to claim 1, wherein said identifying unit identifies said process parameter of said halftone process based on space between the barycentric positions of a plurality of labels obtained from applying a labeling scheme to the image data.

5. An image forming apparatus comprising:

a scanner including a light emitting part configured to emit a light based on image data to form an electrostatic latent image on an image bearing member;

an identifying unit which identifies a process parameter of a halftone process which is applied to the image data which has a binary data and input from a personal computer or other controller;

a forming unit which forms a patch image by applying said halftone process according to said identified process parameter;

a detecting unit which detects the density of said formed patch image;

a comparison unit which compares the difference between a plurality of said detected density with a particular allowable range; and a modification unit which modifies the amount of exposure being one of the image forming conditions if said difference exceeds said particular allowable range.

6. The image forming apparatus according to claim 5, wherein said modification unit modifies said amount of exposure by controlling at least one of luminous intensity or light emission duration of an optical source used for forming said patch image.

* * * * *